US009364074B2

(12) United States Patent
Krasovic

(10) Patent No.: US 9,364,074 B2
(45) Date of Patent: Jun. 14, 2016

(54) BROOM HAVING ARCUATE HEAD

(71) Applicant: John Krasovic, Pueblo, CO (US)

(72) Inventor: John Krasovic, Pueblo, CO (US)

( * ) Notice: Subject to any disclaimer, the term of this patent is extended or adjusted under 35 U.S.C. 154(b) by 0 days.

(21) Appl. No.: 14/536,919

(22) Filed: Nov. 10, 2014

(65) Prior Publication Data

US 2016/0128458 A1 May 12, 2016

(51) Int. Cl.
*A46B 9/02* (2006.01)
*A46B 15/00* (2006.01)

(52) U.S. Cl.
CPC . *A46B 9/02* (2013.01); *A46B 15/00* (2013.01); *A46B 2200/302* (2013.01)

(58) Field of Classification Search
CPC ..... A46B 9/00; A46B 9/02; A46B 15/00; A46B 2200/302
USPC ..... 15/159.1, 160, 171; D4/130, 132, 135; D32/50, 51
See application file for complete search history.

(56) References Cited

U.S. PATENT DOCUMENTS 3,761,990 A 10/1973 Lynn
4,109,338 A * 8/1978 Mertes ..... 15/105
D321,793 S * 11/1991 Bryant ..... D4/135
5,774,922 A 7/1998 Bumb
D693,078 S * 11/2013 Nordvik ..... D32/50
D693,079 S * 11/2013 Nordvik ..... D32/50
8,739,348 B1 * 6/2014 Currier ..... 15/159.1
2004/0031116 A1 2/2004 Coleman
2006/0070198 A1 4/2006 DeRoma
2006/0156499 A1 7/2006 DeRoma
2011/0247157 A1 10/2011 Caillou

FOREIGN PATENT DOCUMENTS

FR 1080217 * 12/1954
FR 1123604 * 9/1956
FR 1316689 * 2/1963

* cited by examiner

*Primary Examiner* — Mark Spisich
(74) *Attorney, Agent, or Firm* — The Keys Law Firm PLLC

(57) ABSTRACT

An arcuate head broom apparatus for sweeping debris across a surface while collecting debris being moved in a trapping area. The arcuate head broom apparatus comprises a broomstick, defined as a conventional elongated broom handle having a distal end, connected at the distal end to a broom head assembly. The broom head assembly defines an arcuate assembly base and a plurality of bristles extending downward therefrom. The arcuate assembly base has an inward curved section with squared ends. Because of the curved orientation of the arcuate assembly base, the bristles are collectively oriented in an arcuate shape that creates an inner trapping area. In addition, the squared ends provide a flat end surface that allows the arcuate head broom apparatus to be used in corners and against straight walls.

1 Claim, 1 Drawing Sheet

BROOM HAVING ARCUATE HEAD

BACKGROUND OF THE INVENTION

1. Field of the Invention

This invention relates generally to cleaning tools and, more particularly, to a broom having an arcuate broom head for directing debris into the center area of the broom head.

2. Description of the Prior Art

The use of cleaning tools consisting of stiff fibers attached to, and roughly parallel to, a cylindrical handle, such as a broom, to sweep dirt or debris across a floor and into a desire location is well known. Conventional brooms often comprise a broom head having a plurality of stiff fibers (or bristles) extending therefrom and a broom stick that defines an elongated handle. Accordingly, such brooms can be considered a type of a brush with an elongated handle. Brooms are often used with a dustpan which provides a receptacle where dirt and debris can be directed into by the broom.

A problem which still exists, however, is that conventional flat broom designs, generally defined by a substantially flat broom head, are unable to collect a significant amount of debris trapped by the bristles while sweeping and generally require repeated sweeping of the same area to trap and move all of the debris from the area. Thus, there remains a need for an arcuate head broom apparatus which would allow debris trapped by the bristles to be directed to and collected in an arcuate bristle area. It would be helpful if such an arcuate head broom apparatus eliminated the need for repeated sweeping of the same area to trap and move all of the debris from the area. It would be additionally desirable for such an arcuate head broom apparatus to be employed by both residential and commercial broom designs.

The Applicant's invention described herein provides for an arcuate head broom apparatus which is adapted to collect debris trapped by its bristles in an inner area formed by the arcuate head. The primary components in Applicant's arcuate head broom apparatus are a handle, an arcuate head, and bristles. When in operation, the arcuate head broom apparatus enables the collection of debris in an inner area formed by the arcuate head through the conventional sweeping motion of the broom. As a result, many of the limitations imposed by prior art structures are removed.

SUMMARY OF THE INVENTION

An arcuate head broom apparatus for sweeping debris across a surface while collecting debris being moved in a trapping area. The arcuate head broom apparatus comprises a broomstick, defined as a conventional elongated broom handle having a distal end, connected at the distal end to a broom head assembly. The broom head assembly defines an arcuate assembly base and a plurality of bristles extending downward therefrom. The arcuate assembly base has a body with an inward curved section between two squared ends. Because of the curved orientation of the arcuate assembly base, the bristles are collectively oriented in an arcuate shape that creates an inner trapping area. In addition, the squared ends provide a flat end surface that allows the arcuate head broom apparatus to be used in corners and against straight walls.

It is an object of this invention to provide an arcuate head broom apparatus which would allow debris trapped by the bristles to be directed to and collected in an arcuate bristle area.

It is another object of this invention to provide an arcuate head broom apparatus that eliminated the need for repeated sweeping of the same area to trap and move all of the debris from the area.

It is yet another object of this invention to provide an arcuate head broom apparatus that is employed in both residential and commercial broom designs.

These and other objects will be apparent to one of skill in the art.

DETAILED DESCRIPTION OF THE INVENTION

Figure 1A:
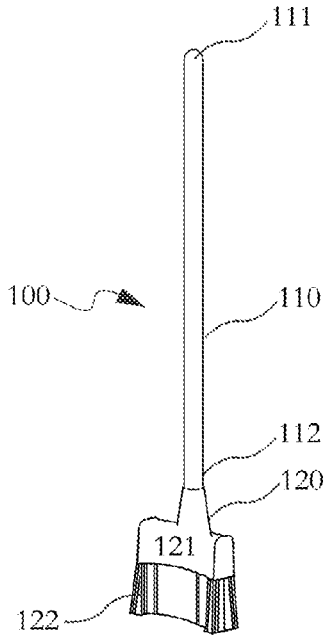
FIG. 1A is a side perspective view of the residential broom model of an arcuate head broom apparatus built in accordance with the present invention.
Figure 1B:
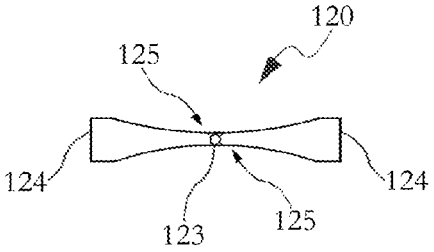
FIG. 1B is a top plan view of the broom head assembly of the residential broom model of an arcuate head broom apparatus built in accordance with the present invention.

Referring now to the drawings and in particular FIGS. 1A and 1B, an arcuate head broom apparatus 100 is shown having a broomstick 110 connected at one end to a broom head assembly 120. The broomstick 110 defines a conventional elongated residential broom handle having a proximal end 111 and a distal end 112. The distal end 112 of the broomstick 110 is permanently attached to the top of the broom head assembly 120. As with conventional brooms, the broomstick 110 provides a user with a means for grasping the arcuate head broom apparatus 100.

The broom head assembly 120 defines an arcuate assembly base 121 and a plurality of bristles 122. The top area of the arcuate assembly base 121 includes a broomstick receptacle 123 that receives the distal end 112 of the broomstick 110 for attachment. The bristles 122 are permanently attached to the bottom of the arcuate assembly base 121 and extend downward therefrom in a manner similar to conventional brooms.

Unlike conventional residential flat brooms, however, the arcuate assembly base 121 has body defining an inward curved section on both sides, with squared lateral ends 124. Because of the curved orientation of the arcuate assembly base 121, the bristles 122 are collectively oriented in an arcuate shape that creates an inner trapping area 125. Through the shape of the arcuate assembly base 121, the broom head assembly 120 provides a means for collecting debris being moved by the arcuate head broom apparatus 100. Having the inward curved body section on both sides enables the arcuate head broom apparatus 100 to be operative when pushed or pulled in either direction.

It is contemplated that the squared ends 124 enable the arcuate head broom apparatus 100 to be used in corners and against straight walls.

Figure 2A:
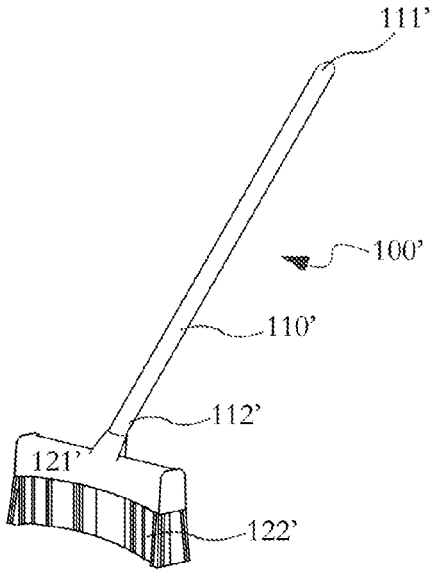
FIG. 2A is a side perspective view of the commercial broom model of an arcuate head broom apparatus built in accordance with the present invention.
Figure 2B:
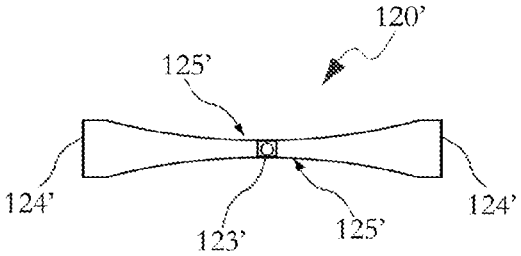
FIG. 2B is a top plan view of the broom head assembly of the commercial broom model of an arcuate head broom apparatus built in accordance with the present invention.

Referring now to FIGS. 2A and 2B, a commercial arcuate head broom apparatus 100' is shown having a broomstick 110' and a broom head assembly 120'. The broomstick 110' defines a conventional elongated commercial broom handle having a proximal end 111' and a distal end 112'. The distal end 112' of the broomstick 110' is permanently attached to the top of the broom head assembly 120'.

The broom head assembly 120' defines an arcuate assembly base 121' and a plurality of bristles 122', both in the design of commercial brooms. The top area of the arcuate assembly base 121' includes a broomstick receptacle 123' that receives the distal end 112' of the broomstick 110' for attachment. The bristles 122' are permanently attached to the bottom of the arcuate assembly base 121' and extend downward therefrom in a manner similar to conventional brooms.

Unlike the straight body of conventional commercial brooms, the arcuate assembly base 121' has a curved body with squared ends 124'. Because of the curved orientation of the arcuate assembly base 121', the bristles 122' are collectively oriented in an arcuate shape that includes an inner trapping area 125'. Through the shape of the arcuate assembly base 121', the broom head assembly 120' provides a means for collecting debris being moved by the arcuate head broom apparatus 100'.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An arcuate head broom apparatus, comprising:

a broomstick defining a conventional broom handle having a distal end; and a broom head assembly defining an arcuate assembly base having a top side, a bottom side, and two opposing, mirror image inward curved sections disposed between two opposing squared ends, wherein said broomstick is attached to the top side of the arcuate assembly base, a plurality of bristles are attached to the bottom side of the arcuate assembly base such that the bristles are collectively oriented in a dual arcuate shape that creates two discrete, opposing inner trapping areas.

* * * * *